US010871747B2

(12) United States Patent
Baebler et al.

(10) Patent No.: US 10,871,747 B2
(45) **Date of Patent: *Dec. 22, 2020**

(54) SAFETY VALVE FOR A TIMEPIECE

(71) Applicant: Meco SA, Grenchen (CH)

(72) Inventors: Jean Baebler, Gumligen (CH); Christian Olvaszto, Grenchen (CH)

(73) Assignee: Meco SA, Grenchen (CH)

( * ) Notice: Subject to any disclaimer, the term of this patent is extended or adjusted under 35 U.S.C. 154(b) by 239 days.

This patent is subject to a terminal disclaimer.

(21) Appl. No.: 16/033,717

(22) Filed: Jul. 12, 2018

(65) Prior Publication Data

US 2019/0025763 A1 Jan. 24, 2019

(30) Foreign Application Priority Data

Jul. 20, 2017 (EP) ..... 17182437

(51) Int. Cl.
*G04B 37/10* (2006.01)

(52) U.S. Cl.
CPC ..... *G04B 37/10* (2013.01)

(58) Field of Classification Search
CPC ..... G04B 37/088; G04B 37/02; G04B 37/10; G04B 37/103; G04B 37/106; F16K 17/02
USPC ..... 368/291, 289–290, 288, 308, 319–321
See application file for complete search history.

(56) References Cited

U.S. PATENT DOCUMENTS

| | | | | |
|---|---|---|---|---|
| 4,292,682 | A * | 9/1981 | Wenger | G04B 37/106 368/289 |
| 5,257,247 | A * | 10/1993 | Miche | G04B 37/103 368/290 |
| 6,137,750 | A | 10/2000 | Rieben | |
| 6,200,020 | B1 | 3/2001 | Rieben | |
| 9,123,483 | B2 * | 9/2015 | Ferri | H01H 13/06 |
| 10,152,024 | B2 * | 12/2018 | Baebler | G04B 3/041 |
| 2019/0025764 | A1 * | 1/2019 | Baebler | G04B 37/103 |
| 2019/0137936 | A1 * | 5/2019 | Podvin | F16K 17/04 |
| 2019/0137937 | A1 * | 5/2019 | Podvin | G04B 37/103 |

FOREIGN PATENT DOCUMENTS

| | | |
|---|---|---|
| EP | 1 124 167 A1 | 8/2001 |
| JP | 2017-15695 | 1/2017 |

OTHER PUBLICATIONS

European Search Report dated Feb. 9, 2018 in European application 17182437.8, filed on Jul. 20, 2017 (with English Translation of Categories of Cited Documents).

* cited by examiner

*Primary Examiner* — Edwin A. Leon
(74) *Attorney, Agent, or Firm* — Obion, McClelland, Maier & Neustadt, L.L.P.

(57) ABSTRACT

An automatic safety valve for a timepiece, especially for a diving watch. The valve includes a valve head, a tube designed to be secured in a case of the timepiece, and an evacuation channel arranged so as to be in fluidic communication with the inside of the case when the safety valve is in an open configuration so as to evacuate an excess of fluid. The safety valve further includes a pressure regulator arranged inside the evacuation channel to maintain the outlet speed of the fluid.

17 Claims, 3 Drawing Sheets

SAFETY VALVE FOR A TIMEPIECE

This application claims priority from European Patent Application No. 17182437.8 filed on Jul. 20, 2017; the entire disclosure of which is incorporated herein by reference

FIELD OF THE INVENTION

The present invention relates to a safety valve designed to be integrated in a crown head of a timepiece and an automatic safety valve designed to be screwed into the caseband of a timepiece. This type of valve is particularly suited for diving watches.

BACKGROUND OF THE INVENTION

It is known how to provide a watch case with a valve in order to allow the blowing of a gas into the case, so as to have a pressure prevailing on the inside which is higher than the ambient pressure, preventing the penetration of water, vapour, or dust inside the case, or to evacuate the inside of the latter so that the movement can avoid the effects of the air contained in the case at the time of its closure.

Even so, these designs have never been used to eliminate the effects on the watch case when it is found in a gaseous environment under heavy pressure for a long period of time. In fact, it has been discovered that, regardless of the sealing qualities of the watch cases produced thus far, when they are subject for relatively long durations on the order of several hours to relatively high pressures on the order of several dozens of atmospheres, and especially when the ambient atmosphere is composed of a gas with molecules of small dimension, such as is the case with helium, for example, which is often used in diving bells, the pressure inside the case ultimately increases appreciably.

Such conditions of use occur in particular when the watch is used at great underwater depths, during the course of work performed under the bell. In the course of the return of the watch to an atmosphere of normal pressure, and this despite the decompression stages which are necessary for the occupants of the bell, an internal overpressure is produced in the watch case, which may cause it to "burst", that is, eject its glass, in particular.

Patent CH682199 discloses an example of a safety valve for a diving watch intended to solve in particular the aforementioned problem. Nevertheless, the configuration of this valve has the drawback of having a reliability of limited duration due in particular to the loss of elasticity of the O-ring seals over the course of time, affecting the opening pressure of the valve.

SUMMARY OF THE INVENTION

One purpose of the present invention is consequently to propose a valve which is reliable in the long term and to thus limit the variations in the opening pressure exerted on the seals during the ascent of the diver, while still guaranteeing a perfect tightness during the dive.

Accordingly, according to a first aspect of the invention, there is proposed a crown head for a timepiece, especially for diving watches, comprising a cap having a cover and an axial skirt, a tube designed to be secured in a case of the timepiece, a sealing gasket arranged between the tube and the axial skirt, and a central pipe designed to be engaged with the tube. The central pipe and the cap form an assembly able to be placed in different axial positions with respect to the tube. The crown head further comprises a safety valve having an evacuation channel designed to be in fluidic communication with the inside of the case when the valve is in an open configuration so as to evacuate an excess of fluid. The safety valve moreover comprises a pressure regulator arranged inside the evacuation channel to control the outlet speed of the fluid.

According to one advantageous embodiment, the pressure regulator comprises a ball arranged to cooperate with a ball seat. This ball is arranged on the ball seat so as to obstruct the passage of a fluid in the evacuation channel when the internal pressure upstream from the ball is less than a predetermined value. The ball is dislodged from its seat when said internal pressure exceeds the predetermined value in order to establish said fluidic communication.

According to one advantageous embodiment, the ball seat, the tube and the axial skirt have a symmetry of revolution with respect to the axis of rotation (A) of the cap. The seat has a central opening corresponding to the inlet of the evacuation channel as well as a bearing surface designed to be in contact with the ball.

According to one advantageous embodiment, the pressure regulator further comprises a piston mounted inside the central pipe and an elastic member designed to cooperate with the piston. The latter is configured to move axially in accordance with pressure variations inside the case.

According to one advantageous embodiment, the piston and the elastic member form an assembly designed on the one hand to actuate the displacement of a control rod, and on the other hand to regulate the pressure inside the case.

According to one advantageous embodiment, the crown head further comprises locking means preventing the cap and the tube from being taken apart. These locking means may be in the form of a guide ring arranged at one end of the tube at least partly on its circumference, the guide ring having a bearing surface designed to exert a pressure on the sealing gasket. According to one embodiment variant, the locking means may be in the form of a shoulder arranged on the internal wall of the tube and comprising a bearing surface against which a portion of the piston can abut and in the form of a flange provided at the base of the central pipe and designed to abut against a shoulder provided on the piston.

According to a second aspect of the invention, there is proposed an automatic safety valve for a timepiece, especially for a diving watch. The valve comprises a valve head, a tube designed to be secured in a case of the timepiece, and an evacuation channel arranged so as to be in fluidic communication with the inside of the case when the safety valve is in an open configuration so as to evacuate an excess of fluid. The safety valve further comprises a pressure regulator arranged inside the evacuation channel to control the outlet speed of the fluid.

According to one advantageous embodiment, the pressure regulator comprises a ball arranged to cooperate with a ball seat. The ball is arranged on the seat so as to obstruct the passage of a fluid in the evacuation channel when the internal pressure upstream from the ball is less than a predetermined value. The ball is dislodged from its seat when said internal pressure exceeds the predetermined value in order to establish said fluidic communication.

According to one advantageous embodiment, the seat as well as the tube have a symmetry of revolution with respect to the axis of rotation (A). The seat has a central opening corresponding to the inlet of the evacuation channel as well as a bearing surface designed to be in contact with the ball.

According to one advantageous embodiment, the pressure regulator further comprises a piston mounted inside the tube and an elastic member designed to cooperate with the piston. The latter is configured to move axially in accordance with pressure variations inside the case.

According to one advantageous embodiment, the external wall of the tube has a threaded portion designed to be screwed into the caseband of the case.

According to one advantageous embodiment, the valve further comprises a retaining ring having an external lateral wall bearing against the circumference of the internal wall of the tube. The retaining ring rests against the ball seat, ensuring the centring of the ball with respect to a reference axis (A).

According to one advantageous embodiment, the valve further comprises a lip seal incorporated in the valve head. The sealing lip bears against the internal wall of the tube when the pressure downstream from the ball is less than a predetermined value. The sealing lip is configured to bend in a direction substantially perpendicular to the internal wall of the tube when the pressure downstream from the ball exceeds the predetermined value in order to allow the evacuation of fluid from the valve.

According to a third aspect of the invention, there is proposed a timepiece, especially a diving watch, comprising at least the regulating crown head according to the first aspect of the invention or the safety valve according to the second aspect of the invention as well as one or more of their advantageous embodiments.

SUMMARY DESCRIPTION OF THE DRAWINGS

Other characteristics and advantages of the present invention will appear upon reading the several embodiments given solely as nonlimiting examples and making reference to the enclosed drawings, in which.

Figure 2:
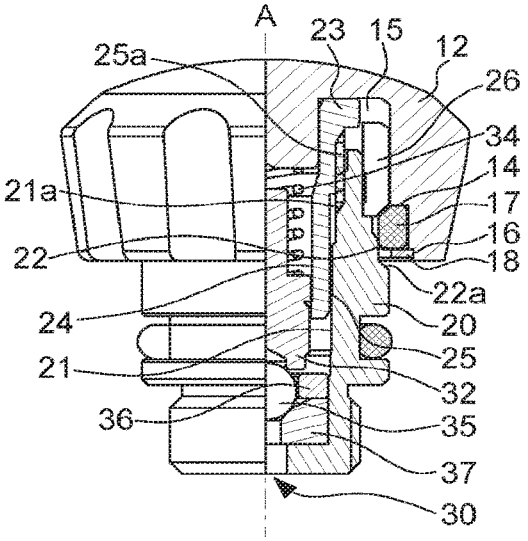
FIG. 2 represents a similar view to FIG. 1 with the regulating crown head in an unscrewed position and the safety valve in an open configuration.
Figure 3A:
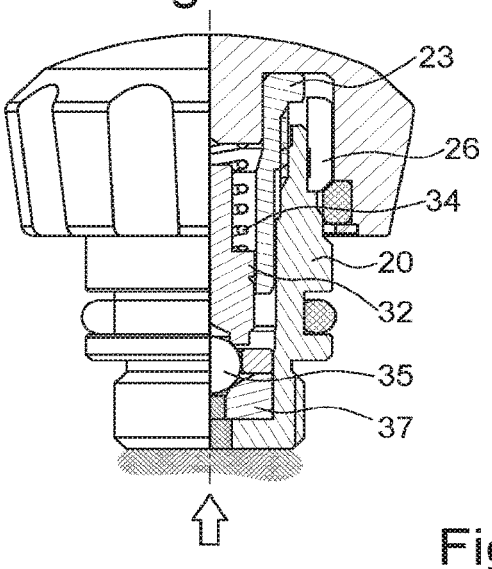
Figure 3B:
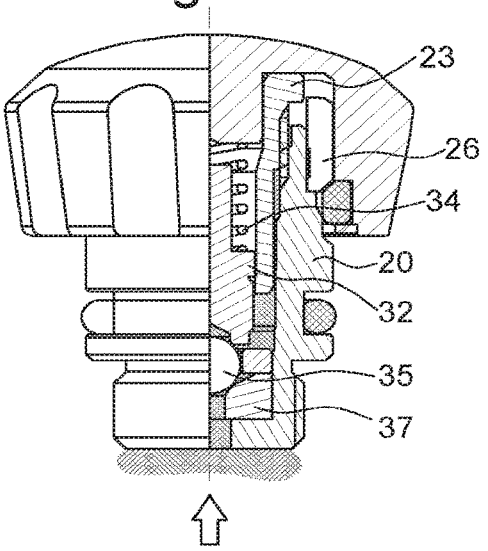
Figure 3C:
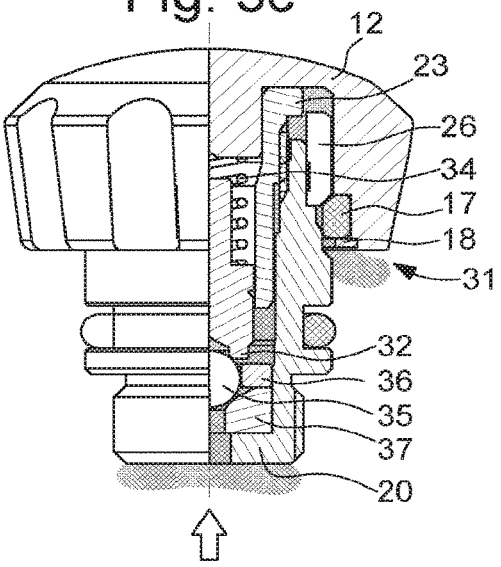
Figure 4:
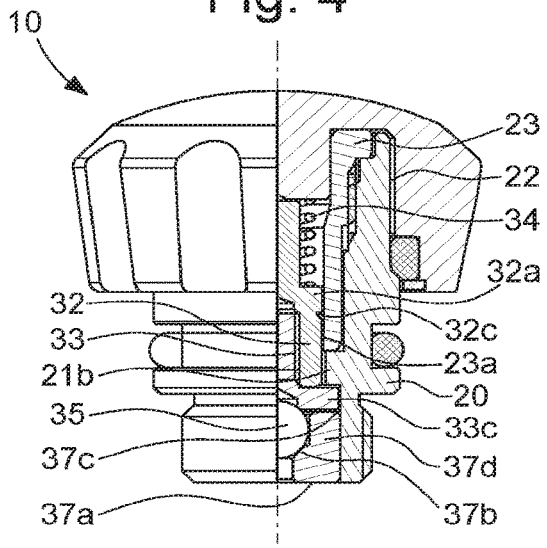
Figure 5:
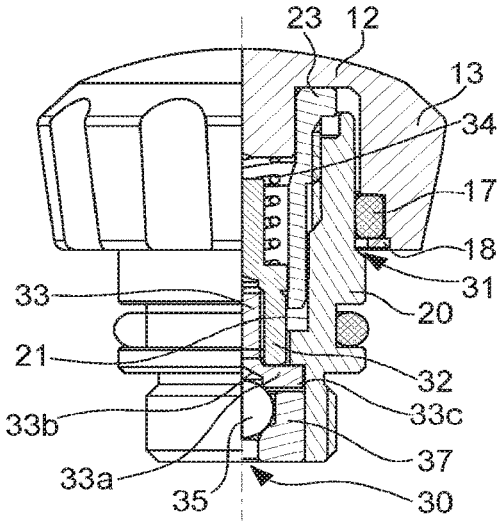
Figure 6A:
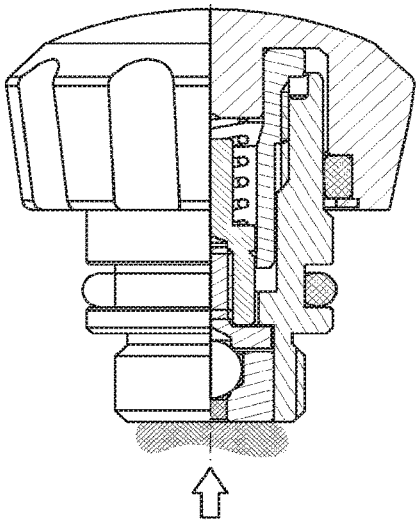
Figure 6B:
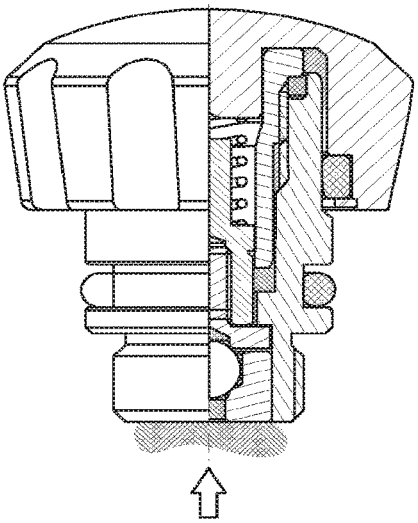
Figure 6C:
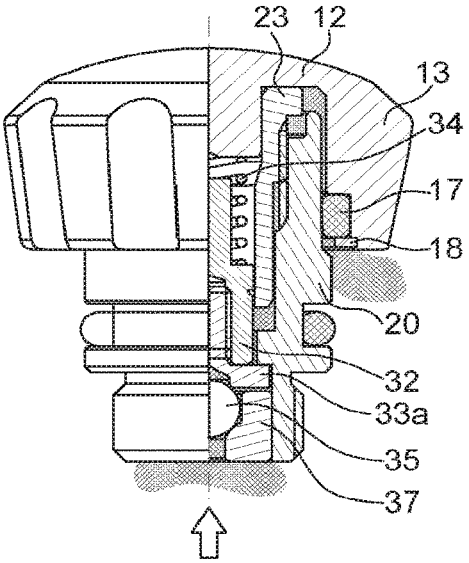
Figure 7:
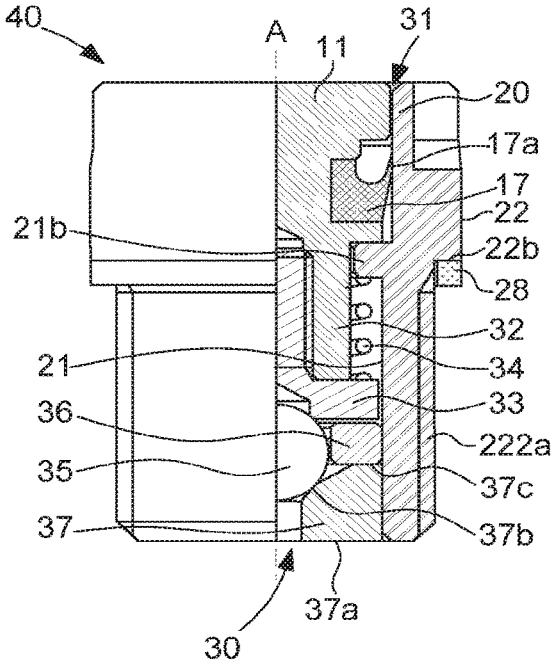
Figure 8A:
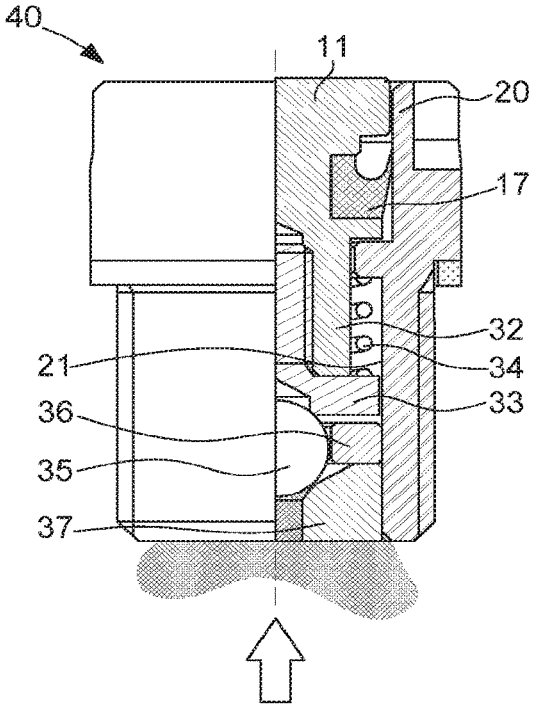
Figure 8B:
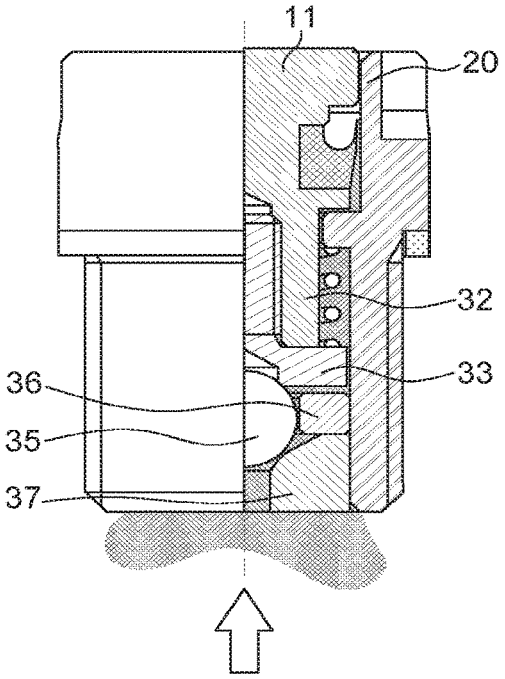
Figure 8C:
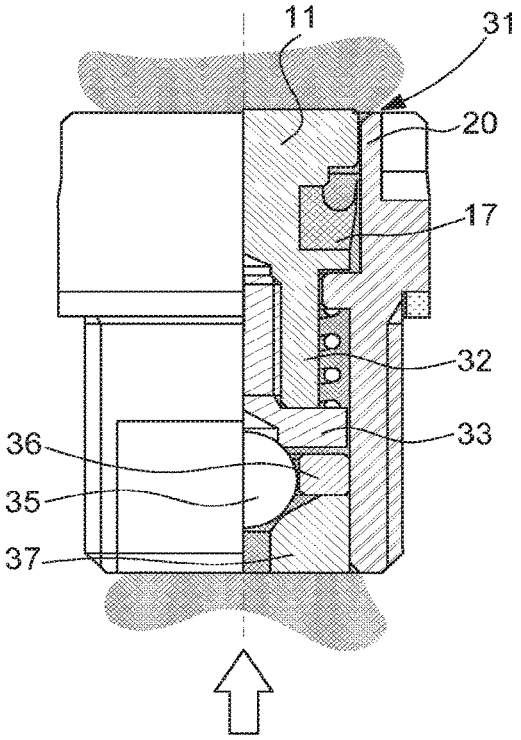

FIGS. 3*a*, 3*b* and 3*c* are each identical to FIG. 2, and they represent schematically the progression of a fluid, such as helium, in the evacuation channel;

FIG. 4 represents a half-section view of a regulating crown head in a position screwed together according to another embodiment with safety valve in a closed configuration;

FIG. 5 represents a similar view to FIG. 4 with the regulating crown head in an unscrewed position and the safety valve in an open configuration;

FIGS. 6*a*, 6*b* and 6*c* are each identical to FIG. 5, and they represent schematically the progression of the fluid in the evacuation channel;

FIG. 7 represents a half-section view of an automatic safety valve according to one embodiment in a closed configuration; and FIGS. 8*a*, 8*b* and 8*c* each represent the valve of FIG. 7 in an open configuration, representing schematically the progression of the fluid in the evacuation channel.

DETAILED DESCRIPTION OF PREFERRED EMBODIMENTS

A regulating crown head 10 in particular for a diving watch according to a first embodiment of the invention will now be described with reference to FIGS. 1 to 3*c*.

The crown head 10 has a tube 20 designed to be secured to a watch case (not shown) by screwing or driving in the caseband of the case. The tube 20 has a threaded portion 21*a* disposed at its internal wall 21 as well as a bulge 22*a* disposed along the circumference of its external wall 22. The crown head 10 likewise has a cap 11, which comprises a cover 12 and an axial skirt 13 having a symmetry of revolution about the axis of rotation A of the cap 11. The cover 12 and the axial skirt 13 of the cap 11 define a cavity 15 in the cap 11. The crown head 10 furthermore has a central pipe 23 arranged in the cavity 15 of the cap 11 and integrated with it. The central pipe 23 has on its external wall 25 a threaded portion 25*a* screwed into the threaded portion 21*a* of the tube 20.

The regulating crown head 10 moreover has a sealing gasket 17 located between the axial skirt 13 of the cap 11 and the tube 20 so as to guarantee the tightness of the crown head regardless of whether the cap 11 is in a first axial position in which the crown head is screwed or in a second axial position in which the crown head is unscrewed. In this embodiment, this sealing gasket 17 is an O-ring. This sealing gasket 17 is arranged between a circular shoulder 14 produced in the axial skirt 13 and a retaining ring 18 of annular shape. This ring 18 is secured, for example, by driving into a groove 16 of corresponding shape, situated toward the base of the axial skirt 13, facing the tube 20.

The crown head 10 furthermore has a guide ring 26 integrated with the end of the tube 20 and disposed in the cavity 15 against a portion of the axial skirt 13. The guide ring 26 is preferably embedded on the end of the tube 20, but it may also be glued or fastened in any other way to the tube 20. This ring 26 has a bearing surface 26*a* able to exert a pressure on the sealing gasket 17.

Figure 1:
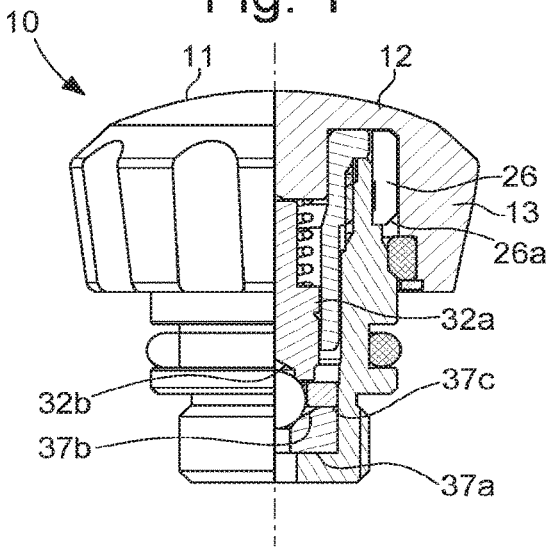
FIG. 1 represents a half-section view of a regulating crown head in a position screwed together with safety valve in a closed configuration according to a first embodiment.

Referring to FIG. 1, the sealing gasket 17 is overcompressed by the bulge 22*a* of the tube 20 such that the sealing properties are the best possible when the cap 11 is located in the first axial position in which the crown head 10 is in a so-called screwed-in configuration. In FIG. 2, the sealing gasket 17 is compressed between the retaining ring 18 on the one hand and the guide ring 26 on the other hand, such that the sealing properties of the crown head 10 are likewise the best possible when the cap 11 is located in the second axial position in which the crown head 10 is in the so-called unscrewed configuration. To accomplish this, the bearing surface 26*a* is preferably oblique with respect to the axis of rotation A of the cap 11. In other words, the guide ring 26 is bevelled.

This ring 26 also prevents the cap 11 being separated from the tube 20 by an excessive unscrewing, since the sealing gasket 17 also serves as an abutment once the cap 11 has reached the second axial position corresponding to the unscrewed configuration of the crown head.

The regulating crown head 10 also comprises a piston 32 lodged in a central opening of the central pipe 23 as well as an elastic member, such as a compression spring 34 of coil type, in a cavity defined by the cap/pipe assemblage on the one hand and by the piston 32 on the other hand. The spring 34 is axially compressed between the cover 12 of the cap 11 and a shoulder 32*a* of the piston 32 and it allows in particular a removing of the cap 11 from the shoulder of the piston 32. The piston 32 kinematically connects the cap 11 to a control rod (not shown) of the timepiece movement which is lodged in the watch case. This control rod allows the wearer to perform different controls depending on the axial position of the cap 11 with respect to the tube 20, for example a winding of the watch when the cap 11 is in a first axial position as illustrated in FIG. 1, or certain corrections, such as resetting the time, when the cap 11 is in a second axial position as illustrated in FIG. 2.

The piston 32 and the spring 34 are also involved in the regulating of the pressure inside the watch case thanks to a safety valve whose detailed description is given below.

The piston and the spring thus form an assemblage having the advantage of being involved in the realization of two primary functions which are independent of one another, namely: the activation of the control rod to perform different adjustments on the one hand, and the regulating of the pressure inside the watch case on the other hand.

So as to subject the seals of the crown head to less stress, and better regulate the pressure variations inside the watch case caused for example by the return of the diver to the surface, a safety valve is integrated in the crown head.

The safety valve according to one embodiment comprises an evacuation channel designed to be in fluidic communication with the inside of the watch case when the valve is in an open configuration so as to evacuate excess pressure from the case. This valve furthermore comprises a pressure regulator arranged inside the evacuation channel to control the outlet speed of a fluid which is present in the form of a gas, preferably helium. For this purpose, the pressure regulator has a ball 35 cooperating with a ball seat 37.

The ball seat 37, the tube 20 and the axial skirt 13 have a symmetry of revolution with respect to the axis of rotation A of the cap 11. The ball and its seat for example may be made from metal, ceramic, or thermoplastic materials, among others.

The seat 37 has an annular base 37*a* with an opening whose axis of revolution coincides with the axis of rotation A of the cap 11. The diameter of this opening is less than the diameter of the ball 35. This opening corresponds to the inlet 30 of the evacuation channel of the valve. The seat 37 likewise comprises a bearing surface 37*b*, which is inclined and circular, and which is meant to be in contact with the ball 35 as well as a peripheral bearing surface 37*c*. A retaining ring 36 having an external lateral wall bearing against the circumference of the internal wall 21 of the tube 20 rests against the peripheral bearing surface 37*c* of the seat 37 so as to encircle the ball 35 and ensure its centring with respect to the axis of rotation A of the cap 11.

The ball 35 is arranged on its seat 37 so as to obstruct the passage of the gas in the evacuation channel when the pressure in the watch case, upstream from the ball, is less than a predetermined value. This value may be adapted to the circumstances, the adaptation being done by the choice of the compression spring 34 which holds one end of the piston 32 bearing against the ball 35. The properties of the spring 34 are thus chosen to manage the force exerted by the piston 32 against the ball 35 in order to control the opening pressure of the valve.

The end of the piston 32 has a cavity 32*b* being essentially conical so as to form, with the seat 37 and the retaining ring 36, a cage bounding off a space in which the ball 35 can move under the effect of the gas pressure. It will be noted, in this regard, that the ball is always under the force of the spring 34 when the crown head 10 is in a screwed-in configuration (FIG. 1), whereas the spring 34 is adjusted so that the ball 35 is free or slightly under force when the crown head 10 is in an unscrewed configuration (FIG. 2).

Referring to FIGS. 3*a*, 3*b*, and 3*c*, the crown head 10 is in an unscrewed configuration when the pressure inside the watch case exceeds a critical threshold. Under the effect of this excessive pressure, the ball 35 is dislodged from its seat 37 allowing the gas to reach the inlet 30 of the evacuation channel (FIG. 3*a*) and then move along this channel (FIG. 3*b*) as far as the outlet 31 of the channel (FIG. 3*c*), in order to allow an evacuation of the gas from the valve.

A regulating crown head 10 for a diving watch according to a second embodiment shall now be described with reference to FIGS. 4 to 6*c*. The principle of operation of the crown head according to this embodiment is identical to that just described. Thus, only the structural differences shall now be described, mainly for reasons of brevity and clarity.

In FIGS. 4 and 5, which illustrate the regulating crown head in a screwed-in and unscrewed configuration, respectively, the pressure regulator comprises a piston 32 having a thread in which a guide screw 33 is screwed. The head 33*a* of the guide screw is disposed opposite the ball 35 and has a central recessed portion 33*b* in the shape of a cone, as well as a peripheral annular portion 33*c* which extends up to the internal wall 21 of the tube 20. The ball seat 37 has an annular base 37*a*, a circular and inclined bearing surface 37*b*, a cylindrical wall 37*d* to ensure the centring of the ball 35 with respect to the axis of rotation A of the cap 11 and a peripheral bearing surface 37*c* disposed opposite the peripheral annular portion 33*c* of the head 33*a* of the guide screw 33. The configuration and the positioning of these different elements also allow the forming of a cage bounding off a space in which the ball can move under the effect of the pressure.

In place of the guide ring according to the first embodiment, the internal wall 21 of the tube 20 has a shoulder 21*b*. The peripheral annular portion 33*c* of the head 33*a* of the guide screw 33 is designed to abut against this shoulder when the cap 11 is moved into its second axial position. Furthermore, a flange 23*a* is provided at the base of the central pipe 23, designed to abut against the lower face of the shoulder 32*a* of the piston 32 and to engage with a notch 32*c* provided for this purpose beneath the lower face of the shoulder 32*a* of the piston 32. Thus, when the crown head 10 is unscrewed, the central pipe 23 will be locked by the shoulder 32*a* of the piston 32, which will itself be locked, since it is joined to the guide screw 33, which is itself locked by the shoulder 21*b* of the tube 20. This makes it possible to avoid an excessive unscrewing of the crown head 10 so as to prevent the cap 11 being removed from the tube 20.

An automatic safety valve 40 especially for a diving watch according to another embodiment will now be described with reference to FIGS. 7 to 8*c*.

In FIG. 7, the automatic safety valve 40 comprises a valve head 11 and a tube 20 joined to the valve head and having on its external wall 22 a threaded portion 222*a* so that the tube 20 can be screwed into the caseband, especially that of a diving watch. Like the valve integrated in the crown head, the automatic valve 40 has an evacuation channel designed to be in fluidic communication with the inside of the watch case when the safety valve is in an open configuration so as to evacuate the excess fluid. The safety valve further comprises a pressure regulator arranged inside the evacuation channel to control the outlet speed of the fluid. This pressure regulator is of the type described in the first two embodiments, likewise having a ball 35 and its seat 37 mounted at the inlet 30 of the evacuation channel. The head of the valve 11 rests against a shoulder 21*b* situated on the circumference of the internal wall 21 of the tube 20. The head 11 comprises a cylindrical extension 32 serving as a piston. The piston 32 extends along a central axis A of the valve 40 in the direction of the ball 35. In this example, the piston 32 has a thread in which a guide screw 33 is screwed. The form of the piston/guide screw assemblage may be a single piece in one variant.

A spring 34 is axially compressed between the valve head 11 and a peripheral portion of the guide screw 33. As with the first embodiment, the seat 37 of the safety valve has an annular base 37*a* comprising an opening whose axis of revolution coincides with the central axis A of the valve. This opening corresponds to the inlet 30 of the evacuation channel of the valve. The seat 37 likewise comprises an inclined and circular bearing surface 37*b* meant to be in contact with the ball 35, as well as a peripheral bearing surface 37*c*. A retaining ring 36 having an external lateral wall bearing against the circumference of the internal wall 21 of the tube 20 rests against the peripheral bearing surface 37*c* of the seat 37 so as to encircle the ball 35 and ensure its centring with respect to the central axis A of the valve 40.

The valve head 11 comprises a lip seal 17*a*. This sealing lip 17*a* abuts against the internal wall 21 of the tube 20 when the pressure downstream from the ball 35 is less than a predetermined value. The sealing lip is designed to bend in a direction substantially perpendicular to the internal wall 21 of the tube 20 when the pressure downstream from the ball 35 exceeds a predetermined value in order to allow the evacuating of fluid from the valve.

The valve 40 furthermore has a shoulder 22*b* at the circumference of the external wall 22 of the tube 20 presenting a bearing surface against which a sealing ring 28 is bonded.

The configuration of the valve according to any one of the embodiments just described presents many advantages, particularly the possibility of adjusting the speed of the fluid at the outlet of the evacuation channel, by a suitable choice of the compression spring, so as to limit the variations in the opening pressure acting on the joints during the return of the diver to the surface. The sealing gasket (an O-ring for the valve integrated in the crown head, a lip seal for the automatic safety valve) is consequently under less stress, which makes it possible to avoid the problems connected with a bonding of the sealing gasket. Moreover, the pressure inside the watch case is regulated in optimal manner, making it possible to avoid a degradation of the different timepiece components which might be caused by overly large pressure variations. Furthermore, the use of a compression spring to regulate the pressure makes it possible to eliminate problems involving parts tolerance.

Of course, the invention is not limited to the embodiments described with regard to the figures and variants might be envisioned without leaving the scope of the invention. For example, the end of the piston acting against the ball might have other forms suitable to limiting the axial displacement of the ball when the valve is in an open configuration. The piston, moreover, may be a single piece or composed of several assembled pieces.

One might equally conceive of the central pipe and the cap forming an assemblage able to be placed in three axial positions with respect to the tube in order to control one or more additional functions. The safety valve according to this variant embodiment might be operational in two of the three axial positions, for example.

LIST OF REFERENCES USED

Regulating crown head 10
Cap 11
Cover 12
Axial skirt 13
Shoulder 14
Cavity 15
Groove 16
Sealing gasket 17
O-ring
Retaining ring 18
Tube 20
Internal wall 21
Threaded portion 21*a*
Shoulder 21*b* (1 embodiment)
Bearing surface
External wall 22
Bulge 22*a*
Central pipe 23
Internal wall 24
External wall 25
Threaded portion 25*a*
Guide ring 26 (alternative)
Bearing surface 26*a*
Safety valve
Evacuation channel
Inlet 30
Outlet 31
Pressure regulator
Piston 32
Shoulder 32*a*
Conically recessed end 32*b*
Guide screw 33
Screw head 33*a*
Recessed central portion 33*b*
Peripheral annular portion 33*c*
Elastic member 34
Coil spring
Ball 35
Retaining ring 36
Ball seat 37
Annular base 37*a*
Inclined bearing surface 37*b*
Peripheral bearing surface 37*c*
Cylindrical wall 37*d*
Automatic safety valve 40
Valve head 11
Sealing gasket 17
Lip seal 17*a*
Tube 20
Internal wall 21
Shoulder 21*b*
External wall 22
Threaded portion 222*a*
Shoulder 22*b*
Bearing surface
Sealing ring 28
Evacuation channel
Inlet 30
Outlet 31
Pressure regulator
Piston 32
Guide screw 33
Elastic member 34
Coil spring
Ball 35
Retaining ring 36
Ball seat 37
Annular base 37*a*
Inclined bearing surface 37*b*
Peripheral bearing surface 37*c*

What is claimed is:

1. A crown head for a timepiece, comprising:

a cap having a cover and an axial skirt;

a tube designed to be secured in a case of the timepiece;

a sealing gasket arranged between the tube and the axial skirt;

a central pipe designed to be engaged with the tube, the central pipe and the cap forming an assembly able to be placed in different axial positions with respect to the tube; and a safety valve having an evacuation channel designed to be in fluidic communication with the inside of the case when the valve is in an open configuration so as to evacuate an excess of fluid, wherein the safety valve moreover comprises a pressure regulator arranged inside the evacuation channel to control the outlet speed of the fluid, and wherein the pressure regulator comprises a ball arranged to cooperate with a ball seat, the ball being arranged on the ball seat so as to obstruct the passage of a fluid in the evacuation channel when the internal pressure upstream from the ball is less than a predetermined value, the ball being dislodged from the ball seat when said internal pressure exceeds the predetermined value in order to establish said fluidic communication.

2. The crown head as claimed in claim 1, wherein the ball seat, the tube and the axial skirt have a symmetry of revolution with respect to the axis of rotation of the cap, the ball seat having a central opening corresponding to inlet of the evacuation channel as well as a bearing surface designed to be in contact with the ball.

3. The crown head as claimed in claim 1, wherein the pressure regulator further comprises a piston mounted inside the central pipe and an elastic member designed to cooperate with the piston, which is configured to move axially in accordance with pressure variations inside the case.

4. The crown head as claimed in claim 3, wherein the piston and the elastic member form an assembly designed on the one hand to actuate the displacement of a control rod, and on the other hand to regulate the pressure inside the case.

5. The crown head as claimed in claim 1, further comprising locking means preventing the cap and the tube from being taken apart.

6. The crown head as claimed in claim 5, wherein the locking means comprise a guide ring arranged at one end of the tube at least partly on a circumference of the tube, the guide ring having a bearing surface designed to exert a pressure on the sealing gasket.

7. The crown head as claimed in claim 5, wherein the locking means comprise a shoulder arranged on the internal wall of the tube and comprising a bearing surface against which a portion of the piston can abut and a flange provided at the base of the central pipe and designed to abut against a shoulder provided on the piston.

8. An automatic safety valve for a timepiece, the valve comprising:

a valve head;

a tube designed to be secured in a case of the timepiece;

an evacuation channel arranged so as to be in fluidic communication with the inside of the case when the safety valve is in an open configuration so as to evacuate an excess of fluid; and a pressure regulator arranged inside the evacuation channel to control the outlet speed of the fluid, wherein the pressure regulator comprises a ball arranged to cooperate with a ball seat, the ball being arranged on the ball seat so as to obstruct the passage of a fluid in the evacuation channel when the internal pressure upstream from the ball is less than a predetermined value, the ball being dislodged from the ball seat when said internal pressure exceeds the predetermined value in order to establish said fluidic communication.

9. The valve as claimed in claim 8, wherein the ball seat as well as the tube have a symmetry of revolution with respect to the axis of rotation, the ball seat having a central opening corresponding to an inlet of the evacuation channel as well as a bearing surface designed to be in contact with the ball.

10. The valve as claimed in claim 8, wherein the pressure regulator further comprises a piston mounted inside the tube and an elastic member designed to cooperate with the piston, the piston being configured to move axially in accordance with pressure variations inside the case.

11. The valve as claimed in claim 8, it further comprising a retaining ring having an external lateral wall bearing against the circumference of the internal wall of the tube, the retaining ring resting against the ball seat and ensuring centering of the ball with respect to a reference axis.

12. The valve as claimed in claim 8, further comprising a lip seal incorporated in the valve head, the sealing lip bearing against the internal wall of the tube when the pressure downstream from the ball is less than a predetermined value, the sealing lip being configured to bend in a direction substantially perpendicular to the internal wall of the tube when the pressure downstream from the ball exceeds the predetermined value in order to allow the evacuation of fluid from the valve.

13. A timepiece, comprising:

a regulating crown head comprising:

a cap having a cover and an axial skirt;

a tube designed to be secured in a case of the timepiece;

a sealing gasket arranged between the tube and the axial skirt;

a central pipe designed to be engaged with the tube, the central pipe and the cap forming an assembly able to be placed in different axial positions with respect to the tube; and a safety valve having an evacuation channel designed to be in fluidic communication with the inside of the case when the valve is in an open configuration so as to evacuate an excess of fluid, wherein the safety valve moreover comprises a pressure regulator arranged inside the evacuation channel to control the outlet speed of the fluid, and wherein the pressure regulator comprises a ball arranged to cooperate with a ball seat, the ball being arranged on the ball seat so as to obstruct the passage of a fluid in the evacuation channel when the internal pressure upstream from the ball is less than a predetermined value, the ball being dislodged from the ball seat when said internal pressure exceeds the predetermined value in order to establish said fluidic communication.

14. The timepiece according to claim 13, wherein the timepiece is a diving watch.

15. The crown head as claimed in claim 1, further comprising a retaining ring having an external lateral wall bearing against the circumference of an internal wall of the tube, the retaining ring resting against the ball seat and ensuring centering of the ball with respect to a reference axis.

16. The crown head as claimed in claim 3, wherein the piston includes a cavity configured to directly contact the ball when the crown head is in a screwed-in position.

17. The crown head as claimed in claim 3, wherein the cavity of the piston is conical.

* * * * *